US008548693B2

(12) United States Patent
Numazaki et al.

(10) Patent No.: US 8,548,693 B2
(45) Date of Patent: Oct. 1, 2013

(54) CONTROL DEVICE AND CONTROL METHOD FOR WORKING MECHANISM OF CONSTRUCTION VEHICLE

(75) Inventors: Masatsugu Numazaki, Ibaraki (JP); Isamu Satoh, Ibaraki (JP); Satoshi Kohsuge, Ishikawa (JP); Kyouhei Sawada, Ishikawa (JP); Yoshiaki Saito, Kanagawa (JP); Jun Kawayanagi, Tochigi (JP); Minoru Wada, Ibaraki (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/515,324

(22) PCT Filed: Mar. 10, 2011

(86) PCT No.: PCT/JP2011/055574

§ 371 (c)(1),
(2), (4) Date: Aug. 10, 2012

(87) PCT Pub. No.: WO2011/114974

PCT Pub. Date: Sep. 22, 2011

(65) Prior Publication Data

US 2012/0330515 A1 Dec. 27, 2012

(30) Foreign Application Priority Data

Mar. 15, 2010 (JP) ..... 2010-057908

(51) Int. Cl.
*E02F 3/43* (2006.01)
*E02F 9/22* (2006.01)

(52) U.S. Cl.
USPC ..... 701/50; 91/361; 91/393

(58) Field of Classification Search
USPC ..... 701/50; 91/361, 393
See application file for complete search history.

(56) References Cited

U.S. PATENT DOCUMENTS 4,358,989 A * 11/1982 Tordenmalm ..... 91/361
4,896,582 A * 1/1990 Tordenmalm et al. ..... 91/361
5,424,941 A * 6/1995 Bolt et al. ..... 700/28
5,510,987 A * 4/1996 Song ..... 701/36
5,513,551 A * 5/1996 Morishita ..... 91/459

(Continued)

FOREIGN PATENT DOCUMENTS

JP 63-236827 A 10/1988
JP 09041421 A * 2/1997

(Continued)

OTHER PUBLICATIONS

JPO machine translation of JP 09-41421 A.*

(Continued)

*Primary Examiner* — James Trammell
*Assistant Examiner* — David Testardi
(74) *Attorney, Agent, or Firm* — Posz Law Group, PLC

(57) ABSTRACT

A control device for a work machine on a construction vehicle is provided so that a bucket cylinder is stopped at a target position, with high accuracy achieved in a bucket cylinder length, and with chock held down to a low level. A bucket cylinder length detection section refereces a cylinder length detection table on the basis of a boom angle and a bell crank angle, thereby detecting a bucket cylinder length. A bucket attitude control section controls the bucket cylinder length so that a target position will be reached. Feedback control is performed until a set value which is set short of a target value is reached. After the bucket cylinder length reaches the set value, open loop control is performed until the target value is reached.

10 Claims, 12 Drawing Sheets

(56) References Cited

U.S. PATENT DOCUMENTS

| | | | | |
|---|---|---|---|---|
| 5,537,818 | A * | 7/1996 | Hosseini et al. | 60/327 |
| 6,098,322 | A | 8/2000 | Tozawa et al. | |
| 6,142,259 | A * | 11/2000 | Veletovac et al. | 187/287 |
| 7,318,292 | B2 * | 1/2008 | Helbling et al. | 37/348 |

FOREIGN PATENT DOCUMENTS

| | | | |
|---|---|---|---|
| JP | 10-259618 | A | 9/1998 |
| JP | 11-131532 | A | 5/1999 |
| WO | WO 2006/013821 | | 2/2006 |

OTHER PUBLICATIONS

JPO machine translation of JP 09-41421 A (original JP document published Feb. 10, 1997).*

The International Search Report mailed on May 10, 2011 for the corresponding International Patent Application No. PCT/JP2011/055574 (with English translation).

* cited by examiner

FIG. 4

102 bucket cylinder length table

| boom angle θa \ bell crank angle θb | 0 | 5 | 10 | 15 | 20 | 25 | 28 | 31 | 34 | 37 | 40 | 43 | 46 | 50 | 65 |
|---|---|---|---|---|---|---|---|---|---|---|---|---|---|---|---|
| −50 | L10 | L11 | L12 | L13 | L14 | L15 | L16 | L17 | L18 | L19 | L20 | L21 | L22 | L23 | L24 |
| −45 | L30 | L31 | L32 | L33 | L34 | L35 | L36 | L37 | L38 | L39 | L40 | L41 | L42 | L43 | L44 |
| −40 | L50 | L51 | L52 | L53 | L54 | L55 | L56 | L57 | L58 | L59 | L60 | L61 | L62 | L63 | L64 |
| −35 | L70 | L71 | L72 | L73 | L74 | L75 | L76 | L77 | L78 | L79 | L80 | L81 | L82 | L83 | L84 |
| −30 | L90 | L91 | L92 | L93 | L94 | L95 | L96 | L97 | L98 | L99 | L100 | L101 | L102 | L103 | L104 |
| ... | ... | ... | ... | ... | ... | ... | ... | ... | ... | ... | ... | ... | ... | ... | ... |
| 50 | L410 | L411 | L412 | L413 | L414 | L415 | L416 | L417 | L418 | L419 | L420 | L421 | L422 | L423 | L424 |

CONTROL DEVICE AND CONTROL METHOD FOR WORKING MECHANISM OF CONSTRUCTION VEHICLE

CROSS REFERENCE TO RELATED APPLICATIONS

This application is a U.S. national stage application of PCT/JP2011/055574 filed on Mar. 10, 2011 and is based on Japanese Patent Application No. 2010-057908 filed on Mar. 25, 2010, the disclosures of which are incorporated herein by reference.

TECHNICAL FIELD

The present invention relates to a control device and a control method for a working mechanism of a construction vehicle.

BACKGROUND

A wheel loader, which is one example of a construction vehicle, for example, performs excavation by pushing a bucket into a heap of earth or sand or the like, while holding the bucket in a state horizontal to the surface of the ground. Accordingly, it is very important to ensure that the bucket is horizontal. Thus, a technique has been proposed with which it is possible to keep the bucket angle fixed by controlling the cylinder length of the bucket cylinder (see Patent Document #1).

PRIOR ART DOCUMENTS

Patent Literature

Patent Document #1: PCT Publication No. WO 2006-013821.

SUMMARY

In the prior art, the angle of the bucket with respect to the ground when the boom is lowered and the bucket is grounded is maintained at the desired value by controlling the cylinder length of the bucket cylinder. With the prior art technique, when the cylinder length reaches the control origin, the flow rate of working fluid supplied to the bucket cylinder is gradually reduced, so that the cylinder length stops at the target value.

However, with this prior art technique, the accuracy of the stopping position is low, because the amount of working fluid supplied to the bucket cylinder is controlled by open loop control. If, in order to enhance the accuracy, the operation of the bucket cylinder is stopped at the instant that the cylinder length reaches its target value, then a stopping shock is generated. Furthermore, if it is arranged to control the position by using feedback control, then there is a possibility that a hunting phenomenon will occur in the vicinity of the target value.

Thus, the object of the present invention is to provide a control device and a control method for a working mechanism of a construction vehicle, with which it is possible to mitigate the shock when stopping the hydraulic cylinder, and moreover with which it is possible to enhance the accuracy of stopping the hydraulic cylinder. Another object of the present invention is to provide a control device and a control method for a working mechanism of a construction vehicle, with which it is possible to separate usage into feedback control and open loop control, and moreover with which it is possible to control the position of the hydraulic cylinder while according consideration to the load imposed upon the hydraulic cylinder. Yet further objects of the present invention will become clear from the subsequent description of the embodiments.

The control device of the present invention is, according to a first standpoint, a control device for controlling the cylinder length of a predetermined hydraulic cylinder that is used in the working mechanism of a construction vehicle, comprising: a cylinder length detection unit that detects the cylinder length of the predetermined hydraulic cylinder; and a cylinder length control unit that controls the cylinder length of the predetermined hydraulic cylinder; wherein the cylinder length control unit: in a first region from the input of a start command that commands starting of control until the cylinder length arrives at a set value that is set before a target value, feedback controls the cylinder length by supplying hydraulic fluid to the predetermined hydraulic cylinder on the basis of a control characteristic that is set in advance and the cylinder length determined by the cylinder length detection unit; and, in a second region from the set value until the cylinder length arrives at the target value, open loop controls the cylinder length by supplying hydraulic fluid to the predetermined hydraulic cylinder while decreasing the control signal at a predetermined rate.

By adopting a structure of this type, the cylinder length is feedback controlled in the first region in which it is relatively remote from the target value, while the cylinder length is open loop controlled in the second region in which it is relatively close to the target value. Due to this, it is possible to stop the cylinder length at the target value with good accuracy, and moreover it is possible to mitigate the shock during stopping.

And, according to a second standpoint, in the first standpoint, the control characteristic includes a first control characteristic that is used if the cylinder length at the start of control is less than or equal to a control threshold value, and a second control characteristic that is used if the cylinder length at the start of control is greater than the control threshold value; and the cylinder length control unit performs the feedback control on the basis of the first control characteristic if the cylinder length when the start command is inputted is less than or equal to the control threshold value, and performs the feedback control on the basis of the second control characteristic if the cylinder length when the start command is inputted is greater than the control threshold value.

And, according to a third standpoint, in the second standpoint, the predetermined rate includes a first rate that corresponds to the first control characteristic and a second rate that corresponds to the second characteristic; and the cylinder length control unit, in the second region: performs open loop control of hydraulic fluid supplied to the predetermined hydraulic cylinder using the first rate, if the first control characteristic was used in the first region; and performs open loop control of hydraulic fluid supplied to the predetermined hydraulic cylinder using the second rate, if the second control characteristic was used in the first region.

BRIEF DESCRIPTION OF THE DRAWINGS

FIG. 4 shows a table for obtaining bucket cylinder length;

DETAILED DESCRIPTION

In the following embodiments of the present invention will be explained with reference to the drawings, while citing, as examples, cases in which these embodiments are applied to wheel loaders, which serve as examples of construction machines. However, these embodiments may also be applied to construction vehicles other than wheel loaders.

Embodiment #1

Figure 1:
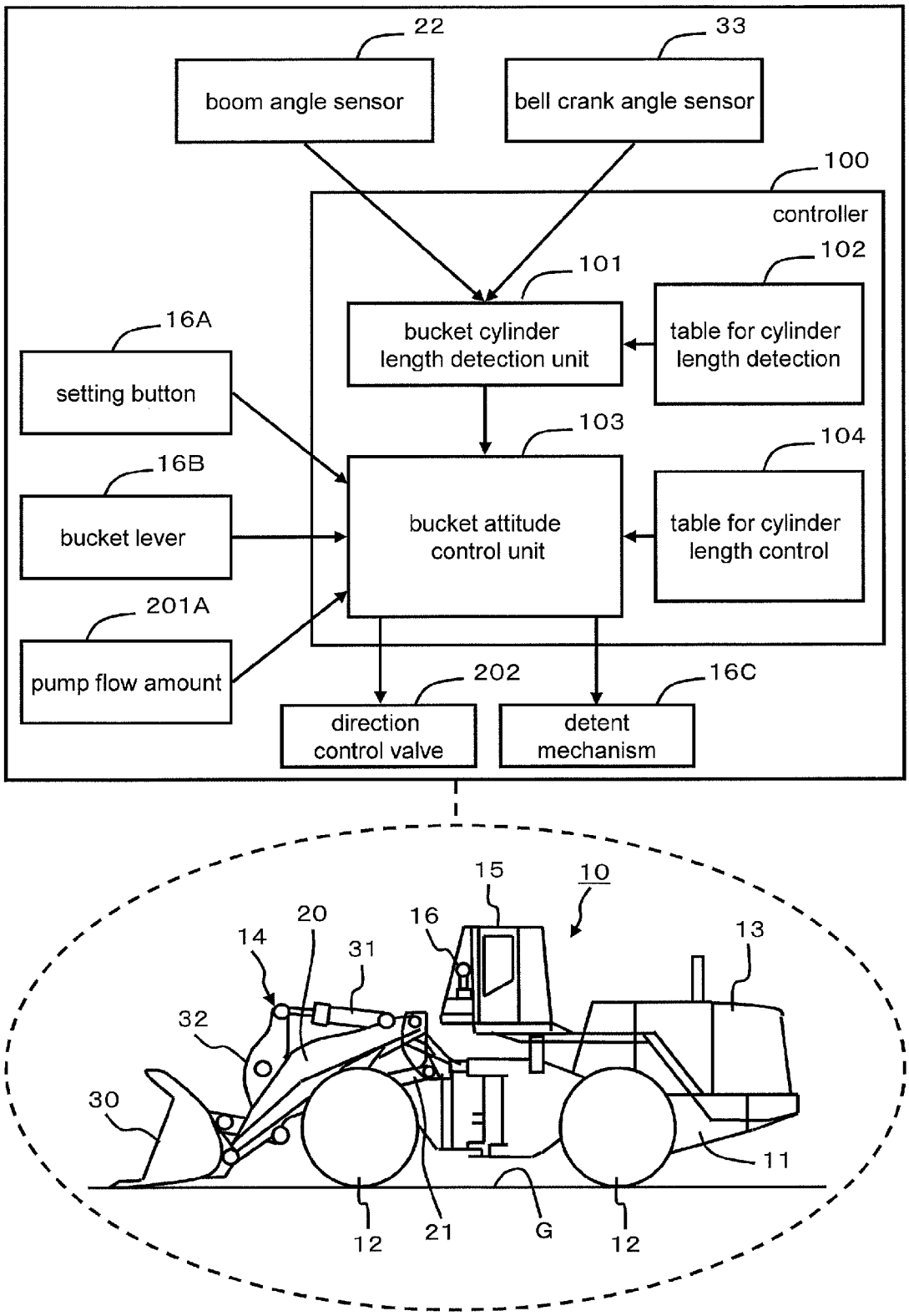
FIG. 1 is an explanatory figure showing an overall summary of an embodiment.

FIG. 1 shows a summary of this embodiment. A wheel loader 10 comprises a vehicle body 11, wheels 12 that are attached to the left and right sides of the vehicle body 11 at its front and rear, a machine compartment that is provided at the rear portion of the vehicle body 11, a working mechanism 14 that is provided at the forward portion of the vehicle body 11, and an operator compartment 15 that is provided at the central portion of the vehicle body 11. A controller 100 that controls this wheel loader 100 and an operating lever device 16 that operates the working mechanism 14 are provided in the operator compartment 15.

The working mechanism 14 comprises a boom 20 that is rotatably provided so as to extend forwards from the front portion of the vehicle body 11, a bucket 30 that is rotatably provided at the end of the boom 20, a boom cylinder 21 that rotates the bucket 20 upwards and downwards, a bucket cylinder for rotating the bucket 30, and a bell crank 32 that links the bucket cylinder 31 and the bucket 30.

Figure 2:
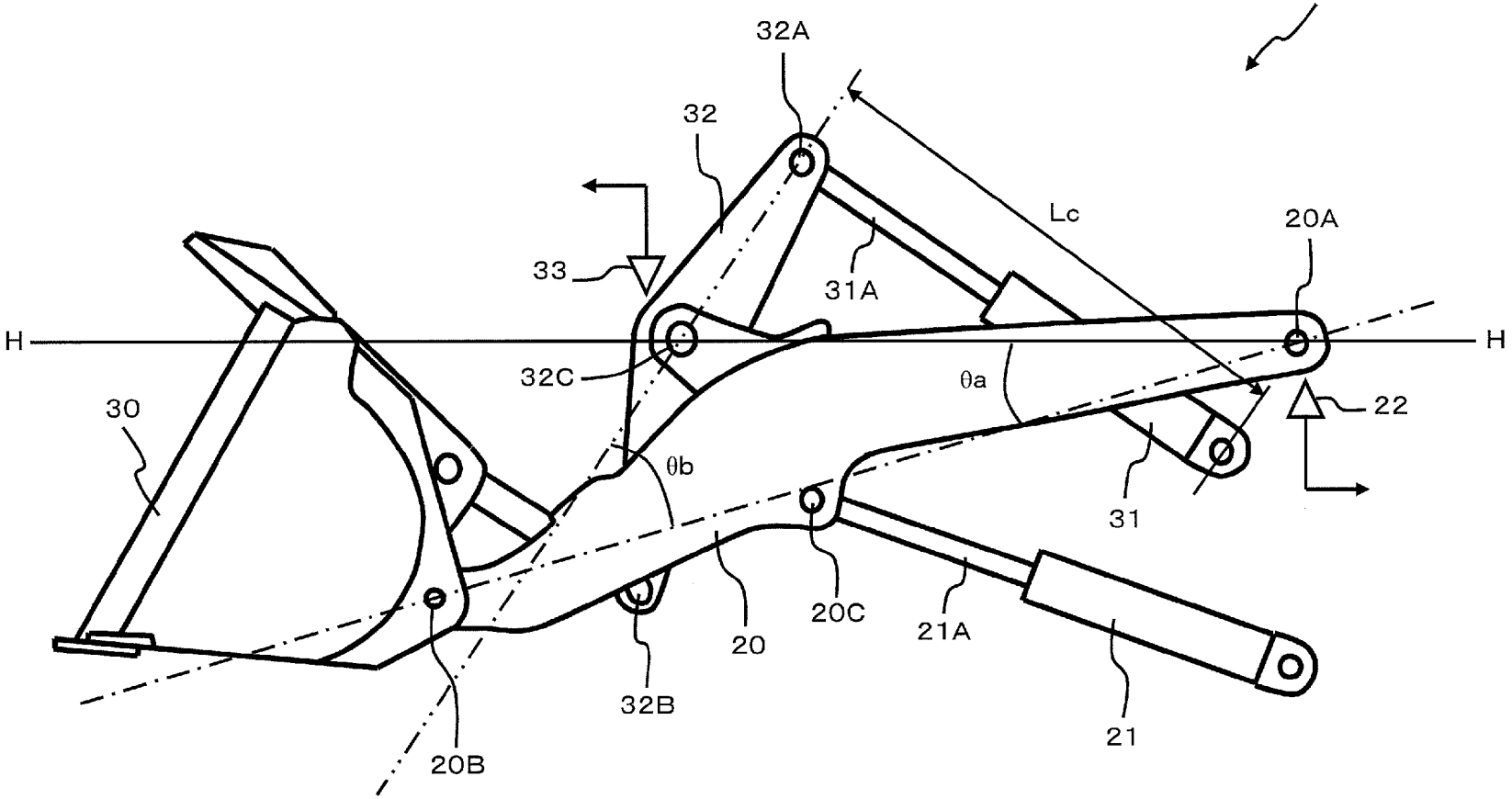
FIG. 2 is an enlarged side view showing a working mechanism.

As shown in the enlarged view of FIG. 2, the central portion 32C of the bell crank 32 is rotatably supported at the center of the boom 20, with one end portion 32A of the bell crank 32 being rotatably attached to the end of the cylinder 31A of the bucket cylinder 31, while the other end portion 32B of the bell crank 32 is rotatably attached to the rear portion of the bucket 30 via a tilt rod. The extension and retraction force of the bucket cylinder 31 is converted by the bell crank 32 into rotational motion, and is transmitted to the bucket 30.

One attachment portion 20A of the boom 20 is rotatably attached to a front portion of the vehicle body 11, while the other attachment portion 20B of the boom 20 is rotatably attached to the rear portion of the bucket 30. And the end of the cylinder rod 21A of the boom cylinder 21 is rotatably attached to a center attachment portion 20C of the boom 20.

As shown in FIG. 2, a boom angle sensor 22 is, for example, provided to the one attachment portion 20A of the boom 20, and detects the boom angle $\theta a$ between the center line of the boom 20 and a horizontal line H and outputs a detection signal. The center line of the boom 20 is the line that connects the one attachment portion 20A of the boom 20 and its other attachment portion 20B.

The bell crank angle sensor 33 is provided at the central portion 32C of the bell crank 32, and detects the bell crank angle $\theta b$ between the line joining the one end 32A of the bell crank 32 and its center 32 and the center line of the boom 20 and outputs a detection signal.

Returning to FIG. 1, the structure of the controller 100 will be explained. This controller 100 may be built as a computer system that comprises a microprocessor, a memory, input and output circuitry, and so on. The controller 100 may, for example, comprise a bucket cylinder length detection unit 101, a bucket cylinder length table 102, a bucket attitude control unit 103, and a table for cylinder length control 104.

The bucket cylinder length detection unit 101, that serves as a "cylinder length detection unit", calculates the present length Lc of the bucket cylinder by, for example, referring to the bucket cylinder length table 102 on the basis of the boom angle $\theta a$ and the bell crank angle $\theta b$. The structure of the bucket cylinder length table 102 will be described hereinafter with reference to FIG. 4. It should be understood that the bucket cylinder length detection unit 101 may also detect the bucket cylinder length by some other method than the method of using the boom angle $\theta a$ and the bell crank angle $\theta b$. For example, it would be acceptable for a sensor for directly measuring the bucket cylinder length to be provided to the structure.

The bucket attitude control unit 103, that serves as a "cylinder length control unit", refers to the table for cylinder length control 104 on the basis of the cylinder length that has been detected, and outputs a control signal to the direction control valve 202. A setting button 16A and a bucket lever 16B are connected to the bucket attitude control unit 103. Furthermore, the discharge amount of a hydraulic pressure pump 201 (i.e. the pump hydraulic fluid amount 201A) is also inputted to the bucket attitude control unit 103. Moreover, the bucket attitude control unit 103 is adapted to be capable of outputting a control signal to a detent mechanism 16C.

Figure 3:
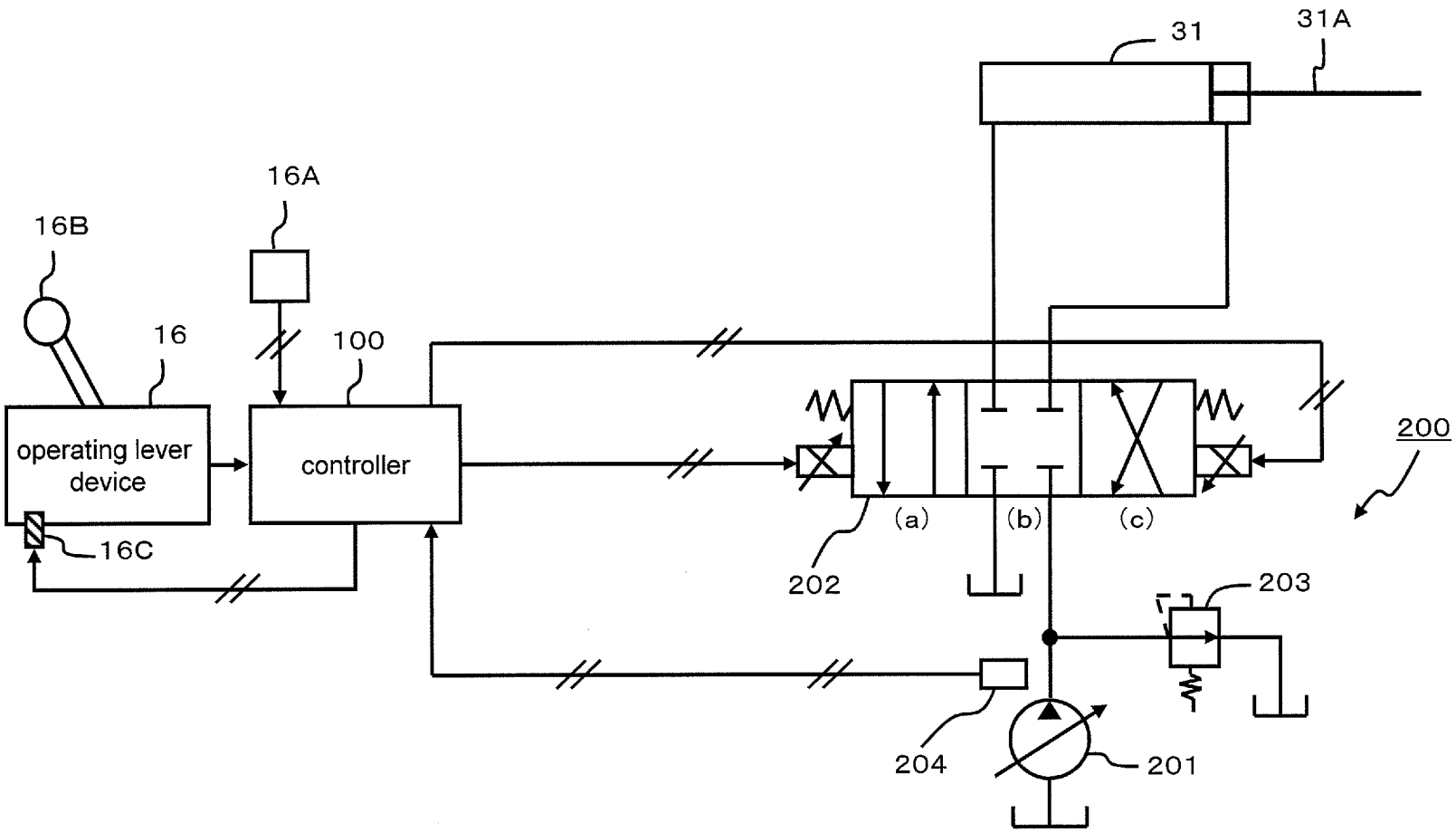
FIG. 3 is a hydraulic pressure circuit of a bucket cylinder.

FIG. 3 is a circuit diagram showing a hydraulic pressure control circuit 200. In FIG. 3, circuitry related to the bucket cylinder 31 is particularly shown. Actually, circuitry for operating the boom cylinder 21 is also included in this hydraulic pressure control circuit 200.

The hydraulic pressure control circuit 200 may, for example, include the sloping plate type hydraulic pressure pump 201, a direction control valve 202, and a relief valve 203. It should be understood that the discharge pressure of the hydraulic pump 201 is detected by a pressure sensor 204 and is transmitted to the controller 100.

The direction control valve 202 may, for example, be built as a two-port three-position changeover valve. The changeover position and the aperture area of the direction control valve 202 are controlled according to control signals (current values) supplied to solenoids that are positioned at the left and right of the direction control valve 202 in FIG. 3. When the direction control valve 202 is changed over to its position (a), the hydraulic fluid discharged from the hydraulic pressure pump 201 is supplied to the hydraulic chamber at the upper end of the bucket cylinder 31 that is positioned on its right side in FIG. 3. Due to this, the cylinder rod 31A is retracted, and a force acts upon the bucket 30 in the dump direction. But when the valve is changed over to its position (c), the hydraulic fluid from the hydraulic pressure pump 201 is supplied to the hydraulic chamber at the lower end of the bucket cylinder 31 that is positioned on its left side in FIG. 3. Due to this, the cylinder rod 31A is extended, and a force acts upon the bucket 30 in the tilt direction. Moreover, when the direction control valve 202 is at its position (b), no hydraulic fluid is supplied to the bucket cylinder 31, and also no hydraulic fluid flows out from the bucket cylinder 31. Accordingly, the cylinder rod 31A is held at its current position.

The operating lever device 16 is provided within the operator compartment 15, and is actuated by the operator. When the bucket lever 16B for controlling the rotation of the bucket 30 is actuated by the operator, this operation signal is transmitted to the controller 100. And the amount of hydraulic fluid supplied to the bucket cylinder 31 is adjusted by the changeover position and the aperture area of the direction control valve 202 being controlled according to this operation signal from the operating lever device 16. It should be understood that, when a predetermined detent condition holds as will be described hereinafter, a detent mechanism 16C within the operating lever device 16 operates, and the operating position of the operating lever 16B is fixed.

Furthermore, a setting button 16A for setting a target value for the cylinder length of the bucket cylinder 31 is provided to the operating lever device 16. By the operator operating this setting button 16A during grounding, the angle of the bucket 30 with respect to the horizontal plane can be set to any desired value between, for example, −5° and +5°. And the operator can store the stopped position of the bucket 30 by pressing the setting button 16A.

An example of the bucket cylinder length table 102, that serves as a "table for cylinder length detection", will now be explained with reference to FIG. 4. In this bucket cylinder length table 102, cylinder lengths are registered in advance in correspondence with, for example, various combinations taken from a plurality of standard boom angles and a plurality of standard bell crank angles.

The standard boom angles are a plurality of boom angles that are set in advance within a predetermined angular range, and are specified by output values of the boom angle sensor 22 determined according to the design. For example, the standard boom angles may be set in divisions of 5° within a range from the boom angle (a lower limit angle, that may for example be −50°) when the boom 20 is at its lowermost position (i.e. the state in which the boom cylinder 21 has been retracted to its mechanical limit) to the boom angle (an upper limit angle, that may for example be 50°) when the boom 20 is at its uppermost position (i.e. the state in which the boom cylinder 21 has been extended to its mechanical limit).

And the standard bell crank angles are a plurality of bell crank angles that are set in advance within a predetermined angular range from another lower limit angle (that may for example be 0°) to another upper limit angle (that may for example be 65°), and that are specified by output values of the bell crank angle sensor 33 determined according to the design. The standard bell crank angles may be set in divisions of, for example, 5° within a range from a lower limit value to an intermediate value (for example 25°), and may be set in divisions of, for example, 3° within a range from the intermediate value to an upper limit value. It should be understood that, in the vicinity of the upper limit value, the standard bell crank angles are set in divisions of 4° or 5°. In other words, the standard bell crank angles are set more finely in the region in which the bucket 30 is positioned near the horizontal.

The bucket cylinder lengths Lc corresponding to various combinations of a standard boom angle and a standard bell crank angle are established in advance. Accordingly, if the boom angle θ*a* and the bell crank angle θ*b* are ascertained, it is possible to calculate the bucket cylinder length Lc from the bucket cylinder length table 102 by performing an interpolation calculation.

With the wheel loader 10 of this embodiment, in the ideal state in which there are absolutely no manufacturing errors or sensor errors, when the boom angle θ*a* is −40° and moreover the bell crank angle θ*b* is 46°, it is arranged for the bucket 30 to be grounded horizontally, with the bucket cylinder length Lc at this time being 2056 mm (=L62 in FIG. 4). Thus, the reference cylinder length of this embodiment is 2056 mm.

It should be understood that, in the ideal state, when a portion of the relationship between the boom angle θ*a*, the bell crank angle θ*b*, and the bucket cylinder length Lc is extracted from the bucket cylinder length table 102, this appears as shown below. The ideal state means that the boom angle sensor 22 and the bell crank angle sensor 33 are outputting signals according to their design specifications, and moreover that no manufacturing errors or assembly errors or the like are present in the working mechanism 14 and so on. It should be understood that, in the following, the format (boom angle θ*a*, bell crank angle θ*b*, bucket cylinder length Lc) is employed.

(−20°, 40°, 2002 mm), (−20°, 43°, 2057 mm), (0°, 34°, 2007 mm), (0°, 37°, 2062 mm), (20°, 28°, 2051 mm), (20°, 31°, 2106 mm), (45°, 15°, 2034 mm), (45°, 20°, 2119 mm)

In a predetermined range (from −40° to the vicinity of 45°) within the range through which the boom 20 can rotate (from −50° to 50°), it is possible to obtain the bucket cylinder length Lc for which the bucket 30 becomes horizontal when the bucket 30 has been grounded.

Figure 5:
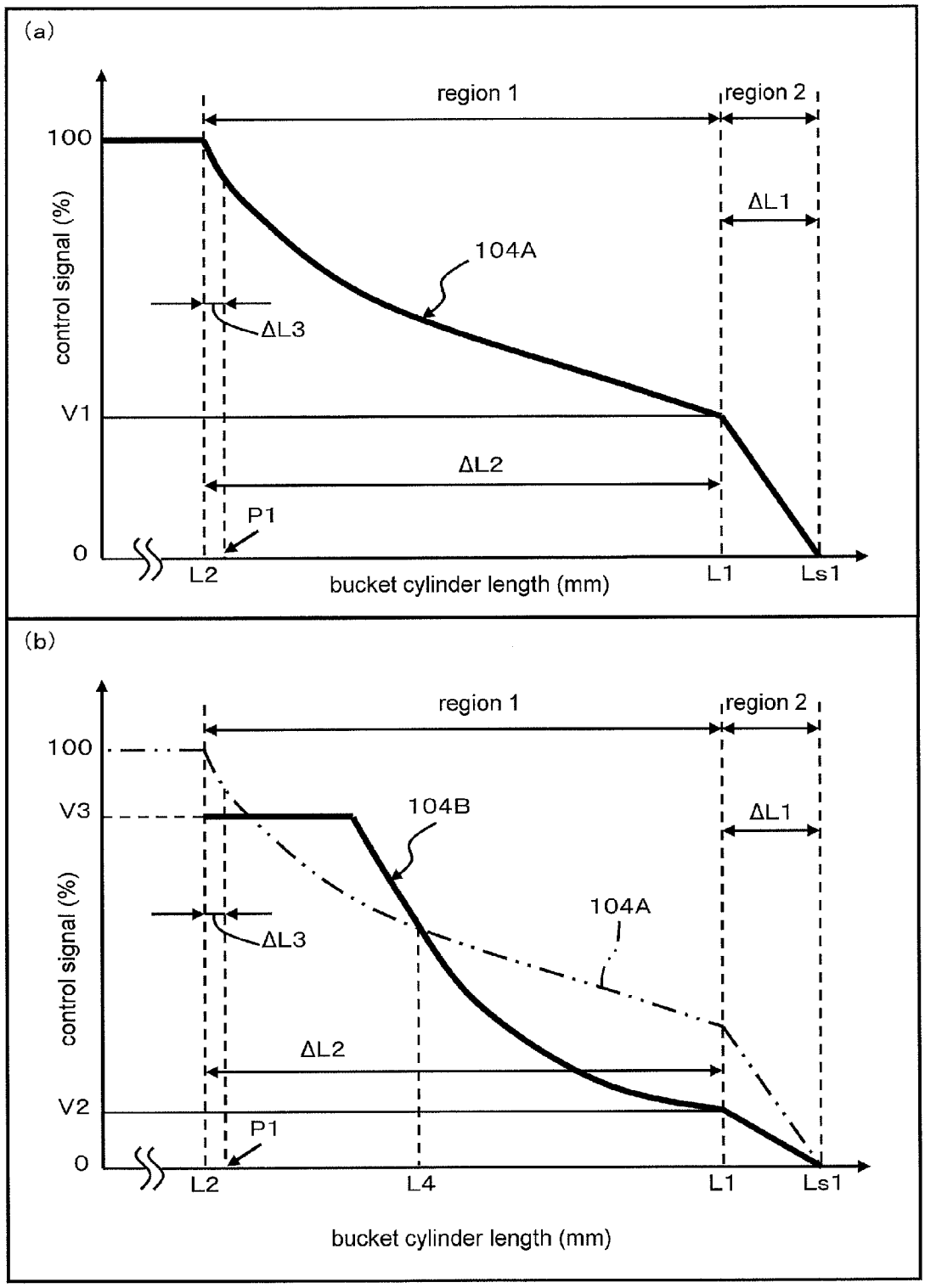
FIG. 5 shows control characteristics for controlling the bucket cylinder length.

FIG. 5 consists of two explanatory figures showing control characteristics for bringing the bucket cylinder length Lc to a target value LS1. The cylinder length of the bucket cylinder is shown along the horizontal axes, while the proportion of the control signal outputted to the direction control valve for actuation of the bucket cylinder 31 to the tilt side is shown along the vertical axes. FIG. 5(*a*) shows a first control characteristic 104A, while FIG. 5(*b*) shows a second control characteristic 104B. In the figures such as FIG. 7 and so on that will be described hereinafter, the first control characteristic 104A is expressed as a first table, while the second control characteristic is expressed as a second table. It should be understood that, in the following explanation and figures, the proportion between the current values inputted to the solenoids in the direction control valve 202 is described as being the control signal.

A set value L1 is set to ΔL1 before the target value LS1. This set value L1 is a target value during feedback control. Accordingly, for example, LS1 may also be alternatively termed the "final target value", while L1 may also be alternatively termed the "target value for feedback control" or the "intermediate target value".

And a control threshold value L2 is set to ΔL2 before the set value L1. This control threshold value L2 is used for making a decision as to which of the first control characteristic 104A shown in FIG. 5(*a*) or the second control characteristic 104B shown in FIG. 5(*b*) is to be selected.

A detent release point P1 is set at a position just ΔL3 from the control threshold value L2. This detent release point P1 is a position for releasing the fixing of the detent mechanism 16C by the electromagnet. The occurrence of abrupt change is prevented by releasing the detent of the bucket lever 16B after starting feedback control. In other words, if the detent were to be released before the start of feedback control, then the bucket lever 16B would be returned to its neutral position, and the direction control valve 202 would change over to its position (b). Due to this, the operation of the bucket cylinder 31 would stop abruptly, which would be undesirable. In order to prevent this sudden stopping, the detent is released after the start of feedback control. To say this again, the value of ΔL3 is discretionary. To express this in an extreme manner, it would also be acceptable for the detent to be released at the same time as exiting from the feedback control routine.

To cite examples of concrete values, the target value LS1 may be set to 2056 mm, the set value L1 may be set to 2050 mm, the control threshold value L2 may be set to 1970 mm, ΔL1 may be set to 6 mm, and ΔL2 may be set to 80 mm. It should be understood that P1 is set to be longer than L2 by a few mm.

The control of the bucket attitude is started when the operator actuates the bucket lever 16B by a predetermined amount Th1 or more. The actuation of the bucket lever 16B by the predetermined amount Th1 or more corresponds to "input of a start command". Before the control according to this embodiment is started, the cylinder length of the bucket cylinder 31 is controlled according to actuation of the bucket lever 16B by the operator. It should be understood that, as will be described hereinafter, the actuation of the bucket lever 16B by the predetermined amount Th1 or more also constitutes a detent start command.

In this embodiment, changing over between a plurality of control methods is performed according to the bucket cylinder length. One of these control methods is feedback control, and another is open loop control. Feedback control is performed in a first region that extends from when the cylinder length is equal to the control threshold value L2 until it arrives at the set value L1. And open loop control is performed in a second region that extends from when the cylinder length is equal to the set value L1 until it arrives at the target value LS1.

In the first region, the magnitude of the control signal outputted to the direction control valve 202 is controlled according to the bucket cylinder length that is detected. In other words, the control signal to the direction control valve 202 is controlled so that the aperture area of the direction control valve 202 decreases according to the characteristic shown by the solid line. In concrete terms, the characteristic for the first region shown by the solid line in FIG. 5 is stored in the table for cylinder length control 104, and a control signal according to this characteristic is outputted to the direction control valve 202. The magnitude of the control signal is V1 when the bucket cylinder length reaches the set value L1.

In the second region, after having arrived at the set value L1, the bucket cylinder length is changed from the set value L1 to the target value LS1 by the control signal being reduced at a constant rate from V1 to 0%. And the rate of decrease is set in advance so that the control signal becomes 0% when the bucket cylinder length has reached the target value LS1. The timing at which the control signal is reduced at the constant rate is determined on the basis of a signal from a clock within the controller 100, not shown in the figures. Due to this, the control signal becomes 0% after a fixed time period has elapsed.

The difference between the first control characteristic 104A shown in FIG. 5(*a*) and the second control characteristic 104B shown in FIG. 5(*b*) will now be explained. First, the first control characteristic 104A will be explained. If, when control starts, the bucket cylinder length Lc is less than the control threshold value L2 (Lc<L2), then the first control characteristic is selected. Since the bucket cylinder length is short when control starts, and the distance to the set value L1 which is the target value for feedback control is long, accordingly the control signal is reduced comparatively gently to V1 from its maximum value of 100%.

Now, the second control characteristic 104B will be explained. If, when control starts, the bucket cylinder length Lc is greater than or equal to the control threshold value L2 (Lc≥L2), then the second control characteristic 104B is selected. As compared to the first control characteristic 104A, with this second control characteristic 104B, the control signal is set to become larger in its earlier half portion (the range below L4 in FIG. 5(*b*)), while the control signal is set to become smaller in the latter half portion (the range from L4 to LS1). With this second control characteristic 104B, after the control signal has been kept at V3 which is a value smaller than 100% for a predetermined interval, it is then reduced to V2 (<V1). The gradient at which the control signal is reduced from V3 to V2 is greater than the gradient at which, according to the first control characteristic 104A, the control signal was decreased from 100% to V1.

As shown in FIG. 5(*b*), in the case of the second control characteristic 104B, in the earlier portion of feedback control, the rate of change of the bucket cylinder length (i.e. its expansion speed) is set to be higher than its rate of change in the case of the first control characteristic 104A. Due to this, when control starts, it is possible to change the bucket cylinder length while providing a speedy feeling, so that it is possible to enhance the operating feeling. In other words in this embodiment, in order to enhance the operating feeling, in the range of bucket cylinder length Lc below L4, it is desirable for the second characteristic 104B to be set to the shape of the first control characteristic 104A, but pulled out somewhat to the upper right. On the other hand, in the later portion of feedback control, the rate of change of the bucket cylinder length is decelerated by reducing the control signal more than in the case of the first control characteristic 104A, and thereby it is brought to arrive at the set value L1.

Figure 6:
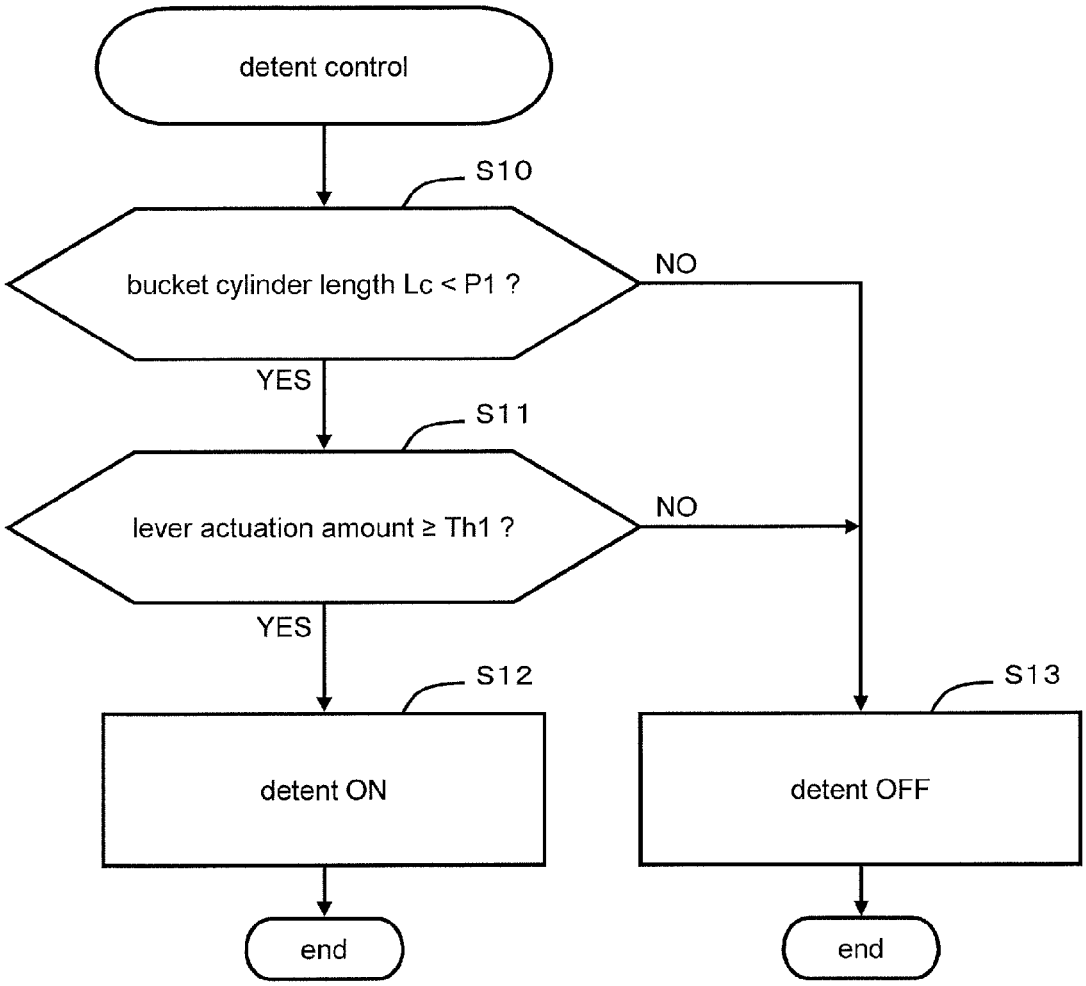
FIG. 6 is a flow chart for a detent control procedure.

FIG. 6 is a flow chart for the detent control procedure. When the bucket lever 16B is actuated by the predetermined amount Th1 or more (for example, Th1=90%), then, according to a signal from the controller 100, the bucket lever 16B is fixed in place by an electromagnet that is provided to the detent mechanism 16C. This temporary fixing of the bucket lever 16B is termed "detent".

The controller 100 makes a decision as to whether or not the current bucket cylinder length Lc is before the detent release position P1 (Lc<P1) (a step S10). As described above, the detent release position P1 is set slightly higher than the control threshold value L2.

If the bucket cylinder length Lc has not arrived at the detent release position P1 (YES in the step S10), then the controller 100 makes a decision as to whether or not the actuation amount of the bucket lever 16B is greater than or equal to the threshold value Th1 (a step S11).

If the actuation amount of the bucket lever 16B is greater than or equal to the threshold value Th1 (YES in the step S11), then the controller 100 fixes the bucket lever 16B by passing electricity through the electromagnet of the detent mechanism 16C (a step S12). By contrast, if the bucket cylinder length Lc is larger than the detent release position P1 (NO in the step S10), or if the actuation amount of the bucket lever 16B is less than the threshold value Th1 (NO in the step S11), then in either case detent is not performed (a step S13). If the result of the decision in either the step S10 or the step S11 is NO, then the detent is released, even if it has already been performed (the step S13).

In other words, the bucket lever 16B is fixed only if the bucket cylinder length is shorter than P1, and also the bucket lever 16B is actuated to greater than or equal to Th1. Accordingly, if the first control characteristic 104A shown in FIG. 5(*a*) is selected, then the detent control becomes ON. This is because, when control starts, the bucket cylinder length is smaller than P1. By contrast, if the second control characteristic 104B shown in FIG. 5(*b*) is selected, then the detent control becomes OFF. This is because, when control starts, the bucket cylinder length is greater than P1.

Figure 7:
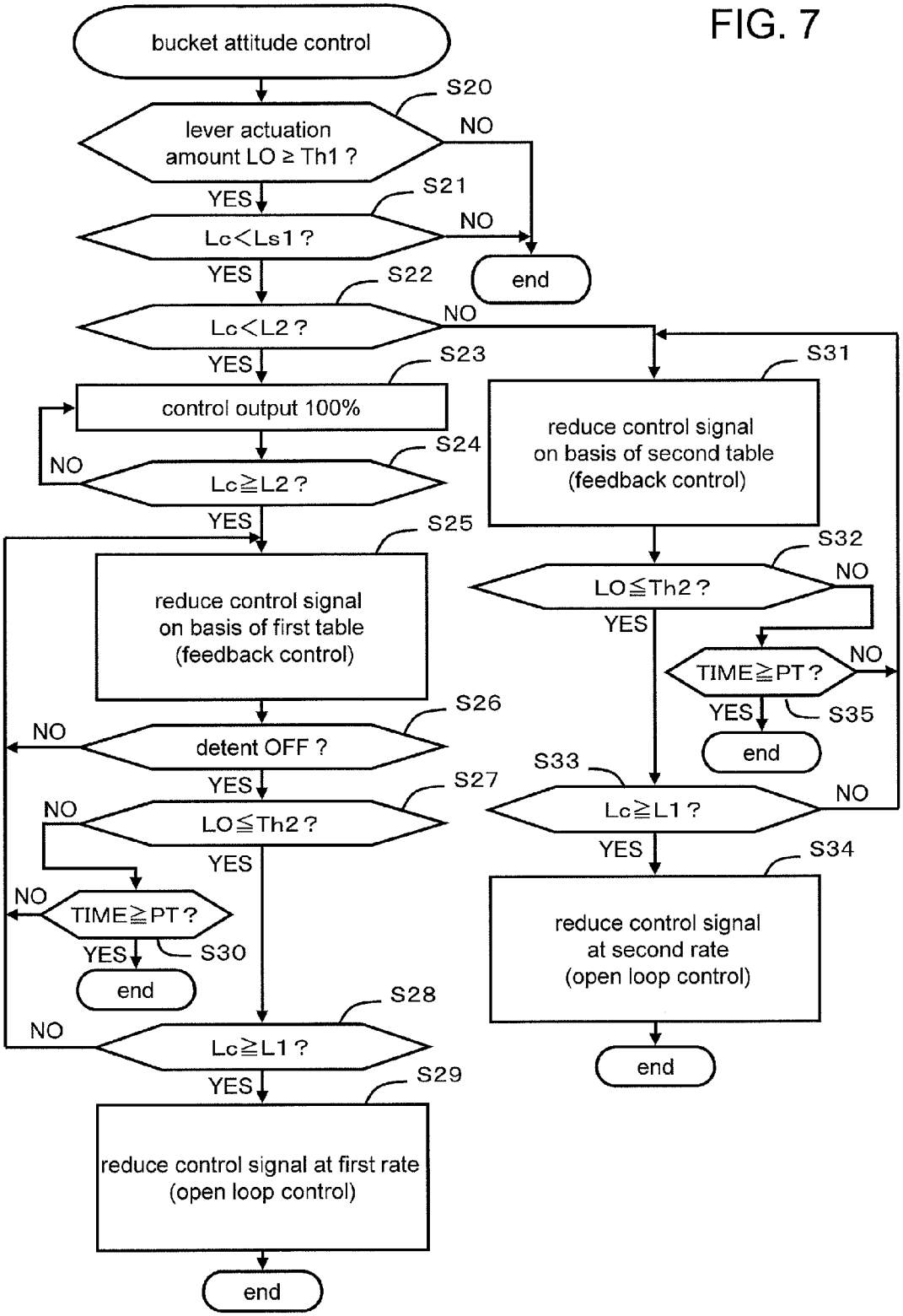
FIG. 7 is a flow chart for a bucket attitude control procedure.

FIG. 7 is a flow chart showing the processing for control of the bucket attitude. The controller 100 makes a decision as to whether or not the actuation amount LO of the bucket lever 16B is greater than or equal to the threshold value Th1 (a step S20). This threshold value Th1 may, for example, be set to around 90%. However, this value should not be considered as being limitative. If the actuation amount LO of the bucket lever 16B is less than the threshold value Th1 (NO in the step S20), then the controller 100 terminates the automatic control of the leveling of the bucket, and the system transitions to manual actuation according to the amount of actuation of the bucket lever 16B. But if the actuation amount LO of the bucket lever 16B is greater than or equal to the threshold value Th1 (YES in the step S20), then the controller 100 makes a decision as to whether or not the current bucket cylinder length Lc is less than the target value LS1 (a step S21). If the current bucket cylinder length Lc is greater than or equal to the target value LS1 (NO in the step S21), then, in a similar manner to that described above, the automatic control of the leveling of the bucket is not performed, and the system transitions to manual actuation. But if the actuation amount LO of the bucket lever 16B is less than the threshold value LS1 (YES in the step S21), then the controller 100 makes a decision as to whether or not the current bucket cylinder length Lc is less than the control threshold value L2 (a step S22).

If the bucket cylinder length Lc is less than the control threshold value L2 (YES in the step S22), then the controller 100 sets the control output to 100% (a step S23). If the result of the decision in the step S22 is YES, then, due to the detent processing shown in FIG. 6, the position of the bucket lever 16B is fixed by the electromagnet. Accordingly, the control signal becomes 100%. Due to this, hydraulic fluid is supplied to the bottom end of the bucket cylinder 31, the cylinder rod 31A extends, and the bucket cylinder length Lc increases.

Next, the controller 100 makes a decision as to whether or not the bucket cylinder length Lc has arrived at L2 (a step S24). If the bucket cylinder length Lc has arrived at the control threshold value L2 (YES in the step S24), then the controller 100 starts feedback control according to the first control characteristic 104A (i.e. according to the first table) (a step S25). Due to this, the bucket cylinder length Lc gradually increases while the speed of extension is decreased, and gets near to the set value L1.

The controller 100 then makes a decision as to whether or not the detent is OFF (a step S26). For example, if in the processing shown in FIG. 6 the setting of a flag is used for managing the ON/OFF state of the detent, then it is possible to determine whether or not the detent is in the OFF state by referring to this flag. If the detent is OFF (YES in the step S26), then the controller 100 makes a decision as to whether or not the actuation amount LO of the bucket lever 16B is less than or equal to the threshold value Th2 (a step S27). This threshold value Th2 is a threshold value for neutral decision, for determining whether or not the bucket lever 16B is in its neutral position. The threshold value Th2 may, for example, be set to around 5% control output. If the actuation amount LO of the bucket lever 16B is less than or equal to the threshold value Th2 (YES in the step S27), then it is decided that the bucket lever 16B is in its neutral position.

Then the controller 100 makes a decision as to whether or not the bucket cylinder length Lc has arrived at the set value L1 (a step S28). When the bucket cylinder length Lc arrives at the set value L1 (YES in the step S28), then the controller 100 terminates the feedback control, and transitions to open loop control (a step S29). Then the bucket cylinder length Lc is extended towards the target value LS1 by the controller 10 reducing the control signal at a first rate that is set in advance (a step S29). The step S29 terminates at the time point that the control signal reaches 0%, and also this processing ends. The feedback control of the step S25 is continued until the bucket cylinder length Lc reaches the set value L1 (NO in the step S28, and the step S25).

On the other hand, if the actuation amount LO of the bucket lever 16B is greater than the threshold value Th2 (NO in the step S27), then it is determined that the bucket lever 16B is not in its neutral position. And the controller 100 waits until the elapsed time from the point that the detent went to the OFF state reaches a predetermined time interval PT (a step S30). The value of this predetermined time interval PT may, for example, be set to around 100 ms. However, this value should not be considered as being limitative. It should be understood that if, even though the predetermined time interval from the detent going into the OFF state has elapsed, the lever actuation amount LO is still above the threshold value L2 for neutral decision (YES in the step S30), then this processing terminates, and the system transitions to manual actuation.

The reason for the provision of the step S30 will now be explained. Due to the processing of FIG. 6, the detent is released when the bucket cylinder length reaches P1 (NO in the step S10, and the step S13). After the detent has been released, feedback control is performed according to either the control characteristic 104A or the control characteristic 104B.

However, consideration should also be given to the case in which, after the detent has been released, the bucket lever 16B continues to be actuated to a position greater than or equal to the neutral position due to the initiative of the operator himself. Since in this case, with the changing of the bucket cylinder length on the basis of the first control characteristic 104A, the speed of change of the bucket cylinder length becomes slower as compared to the actual position of the bucket lever 16B, accordingly this comes to impart a feeling of deceleration or a sense of discomfort to the operator. Thus if, when releasing the detent, the state in which the actuation amount of the bucket lever 16B is at least the threshold value Th2 has continued for the predetermined time interval PT or longer, then the controller 100 decides that the bucket lever 16B is being actuated according to the will of the operator, and thus controls the direction control valve 202 according to the actuation of the bucket lever 16B.

If the result of the decision in the step S22 is NO, then the controller 100 performs feedback control according to the second control characteristic 104B (i.e. according to the second table) until the bucket cylinder length Lc reaches the set value L1 (a step S31). The controller 100 makes a decision as to whether or not the actuation amount LO of the bucket lever 16B is less than or equal to the threshold value Th2 (a step S32). If the actuation amount LO of the bucket lever 16B is less than or equal to the threshold value Th2 (YES in the step S32), then a decision is made as to whether or not the bucket cylinder length Lc has reached the set value L1 (a step S33). The feedback control is performed until the bucket cylinder length Lc reaches the set value L1 (NO in the step S33, and the step S31). But when the bucket cylinder length Lc reaches the set value L1 (YES in the step S33), then the controller 100 extends the bucket cylinder length Lc towards the target value LS1 by reducing the control signal at a second rate that corresponds to the second control characteristic 104B (a step S34). And, at the time point that the control signal becomes 0%, the step S34 terminates and this processing terminates.

On the other hand, if the actuation amount LO of the bucket lever 16B is greater than the threshold value Th2 (NO in the step S32), then the controller 100 makes a decision as to whether or not the predetermined time interval PT has elapsed (a step S35). The controller 100 executes feedback control until the predetermined time interval PT has elapsed (NO in the step S35, and the step S31). It should be understood that if, even though the predetermined time interval has elapsed, the bucket lever actuation amount LO is still above the threshold value Th2 (YES in the step S35), then the feedback control of the step S31 terminates, and the system transitions to manual actuation.

Moreover it should be understood that, if the detent release point P1 is set to be close to the control threshold value L2 (ΔL3<a few millimeters), it would also be acceptable to arrange for the predetermined time interval PT of the step S30 to be set to a time interval (for example, 150 ms) which is a sufficient interval for the bucket cylinder length Lc to pass through the control threshold value L2, and which is moreover sufficient for the detent to be released. In this case, the decision step S26 may be omitted. As described above, it would also be acceptable for a plurality of timings for starting the measurement of the predetermined time interval PT to be provided, and it would also be acceptable to set a plurality of values for the predetermined time interval PT. One or another of these timings and these values would be employed, according to the situation.

According to this embodiment having the structure described above, the cylinder length of the bucket cylinder 31 is brought to the target value LS1 by performing feedback control until the cylinder length arrives at the set value L1, and by performing open loop control after the cylinder length arrives at the set value L1. Accordingly, with this embodiment, hunting does not occur, and moreover it is possible to bring the cylinder length of the bucket cylinder 31 to the set value at high speed. Due to this, in this embodiment, it is possible to enhance the accuracy of stopping of the bucket cylinder 31, and it is possible to control the angle of the bucket 30 with respect to the ground at high accuracy.

Furthermore, in this embodiment, feedback control is performed until the bucket cylinder length gets sufficiently close to the target value LS1, and, when the bucket cylinder length has gotten close to the target value LS1 (Lc≥L1), then the feedback control is stopped, and the bucket cylinder length is changed at a constant rate. Accordingly, it is possible to suppress the occurrence of hunting due to the feedback control, and moreover it is possible to enhance the accuracy of stopping.

Furthermore since, in this embodiment, the bucket cylinder length is extended at a constant rate after the bucket cylinder length has reached L1, accordingly it is possible to mitigate the shock during stopping, and it is possible to improve the ease of use.

Furthermore, in this embodiment, when the control is started, either one of the first control characteristic 104A and the second control characteristic 104B is selected according to the bucket cylinder length, and feedback control is performed on the basis of the selected control characteristic. Accordingly, it is possible to improve the ease of use. In particular, even when control is started in a state in which the bucket cylinder length is comparatively close to the target value, still it is possible to make the speed of change of the bucket cylinder length be comparatively fast, so that it is possible to enhance the ease of use by the operator.

Embodiment #2

A second embodiment will now be explained with reference to FIGS. 8 through 11. Including this embodiment, the following embodiments are equivalent to variants of the first embodiment. Accordingly, the explanation thereof will concentrate upon the points of difference from the first embodiment. In this embodiment, the control characteristic is selected according to the load that is imposed upon the bucket cylinder 31.

Figure 8:
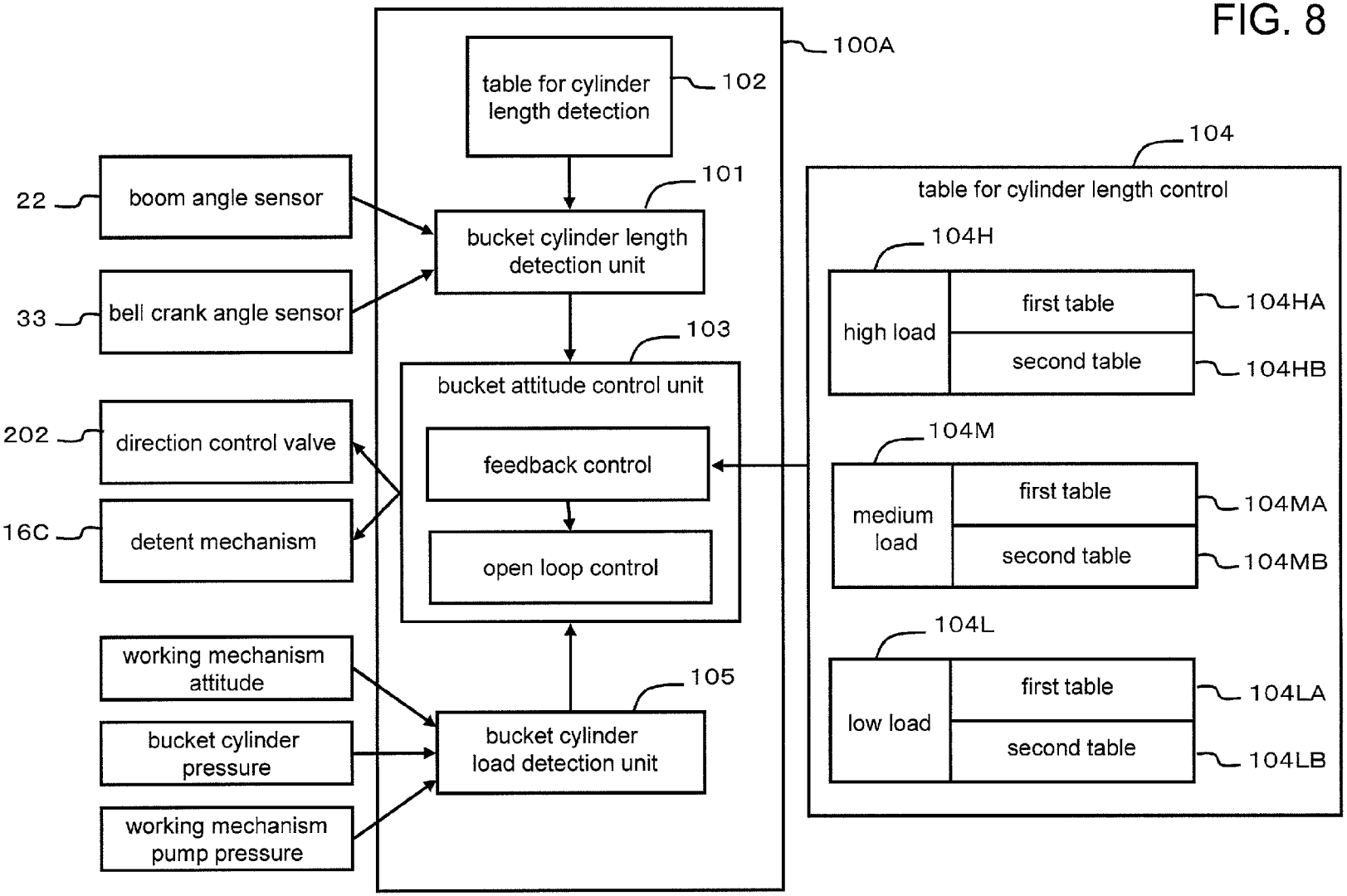
FIG. 8 is a block diagram showing the structure of a controller according to a second embodiment.

FIG. 8 is a block diagram of a controller 100A. Like the controller 100 described above, the controller 100A of this embodiment, comprises a bucket cylinder length detection unit 101, a table for cylinder length detection 102, a bucket attitude control unit 103, and a table for cylinder length control 104.

The controller 100A of this embodiment comprises a bucket cylinder load detection unit 105 for detecting the load upon the bucket cylinder 31. The way in which the load upon the bucket cylinder 31 is determined will be described hereinafter with reference to FIGS. 9 and 10.

Moreover, the table for cylinder length control 104 of this embodiment comprises first control characteristics 104A (first tables) and second control characteristics 104B (second tables) corresponding to each of a plurality of load stages of the bucket cylinder 31.

For example, if three stages of load, i.e. high load 104H, medium load 104M, and low load 104L, are distinguished, then a first control characteristic 104A and a second control characteristic 104B will be prepared for each of these stages "high load 104H", "medium load 104M", and "low load 104L". The reference symbols 104HA and 104HB will be respectively appended to the first control characteristic 104A and to the second control characteristic 104B which are employed in the case of high load 104H. In a similar manner, the reference symbols 104MA and 104MB will be respectively appended to the first control characteristic 104A and to the second control characteristic 104B which are employed in the case of medium load 104M. And, in a similar manner, the reference symbols 104LA and 104LB will be respectively appended to the first control characteristic 104A and to the second control characteristic 104B which are employed in the case of low load 104L.

Here, for example, if the first control characteristic 104MA and the second control characteristic 104MB for medium load are the characteristics shown in FIG. 5, then the control signal is set to be higher in the case of the first control characteristic 104HA and the second control characteristic 104HB for high load than in that case of medium load, and the control signal is set to be lower in the case of the first control characteristic 104LA and the second control characteristic 104LB for low load than in that case of medium load.

Figure 9:
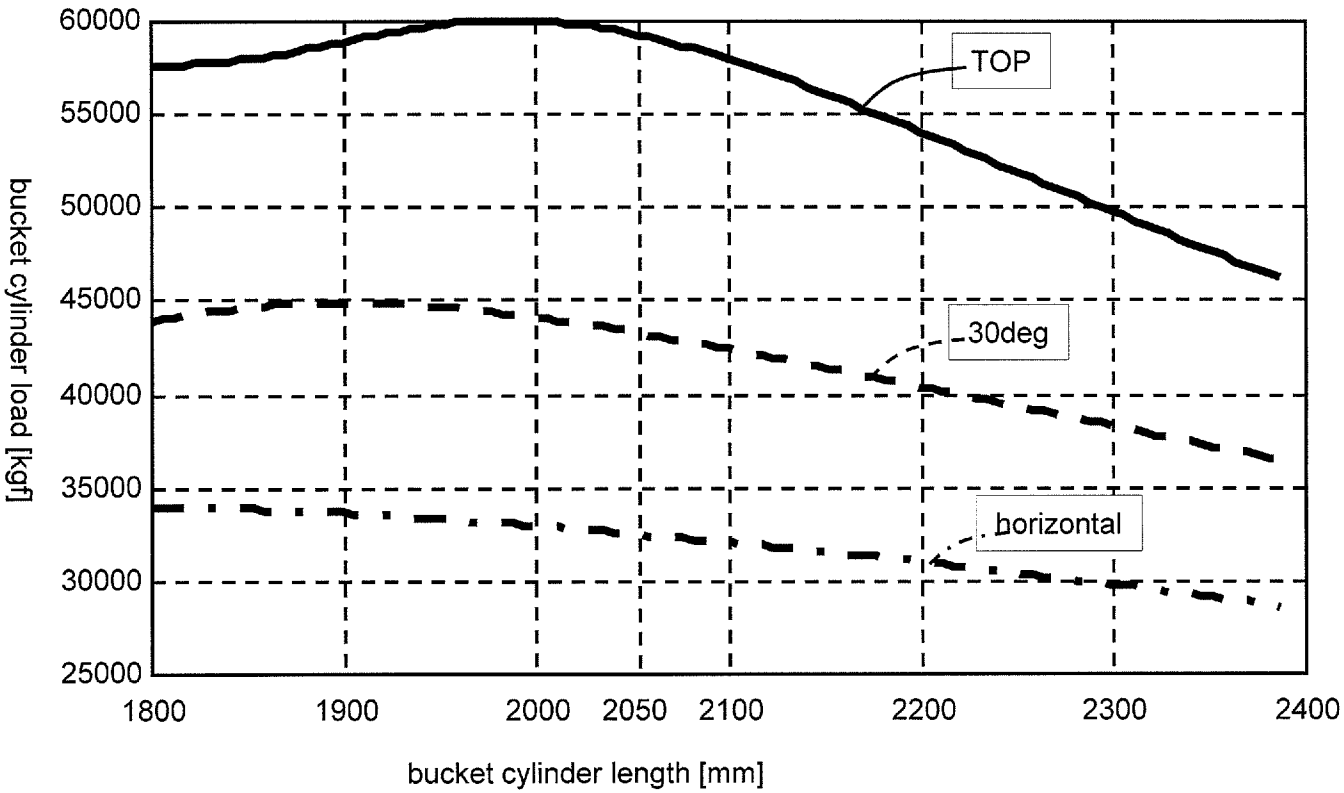
FIG. 9 is a graph showing the way in which the load on the bucket cylinder changes according to boom angle.

Various examples of methods for detecting the load imposed upon the bucket cylinder 31 will now be explained. FIG. 9 is a graph showing the relationship between the attitude of the working mechanism and the load upon the bucket cylinder 31. The load upon the bucket cylinder 31 is shown along the vertical axis, and the bucket cylinder length is shown along the horizontal axis.

FIG. 9 shows the relationship between the bucket cylinder length and the bucket cylinder load for each of three states: when the boom 20 is horizontal; when the boom 20 is inclined at 30°; and when the boom 20 has been raised to its highest position.

As shown in FIG. 9, when the bucket cylinder length has some value, the load imposed upon the bucket cylinder 31 becomes big, and the longer the bucket cylinder length becomes, the more the bucket cylinder load decreases. However, it will be understood that the change of the load due to the boom angle is greater than the change of the load due to the length of the bucket cylinder. In other words, the load imposed upon the bucket cylinder 31 increases, the greater the boom angle becomes. Accordingly, when control starts, the bucket cylinder load detection unit 105 is able to determine or to calculate the load on the bucket cylinder on the basis of the boom angle.

Here, the bucket cylinder load is proportional both to the cylinder pressure of the bucket cylinder 31 and also to the discharge pressure of the pump 201. Accordingly the bucket cylinder load detection unit 105 is able to determine the load upon the bucket cylinder 31 on the basis of either one, or both, of the cylinder pressure of the bucket cylinder 31 and the discharge pressure of the hydraulic pressure pump 201.

Furthermore, the bucket cylinder load detection unit 105 can also detect the cylinder load on the basis of the attitude of the working mechanism 14, the cylinder pressure of the bucket cylinder 31, and the discharge pressure of the hydraulic pump 201.

Figure 10:
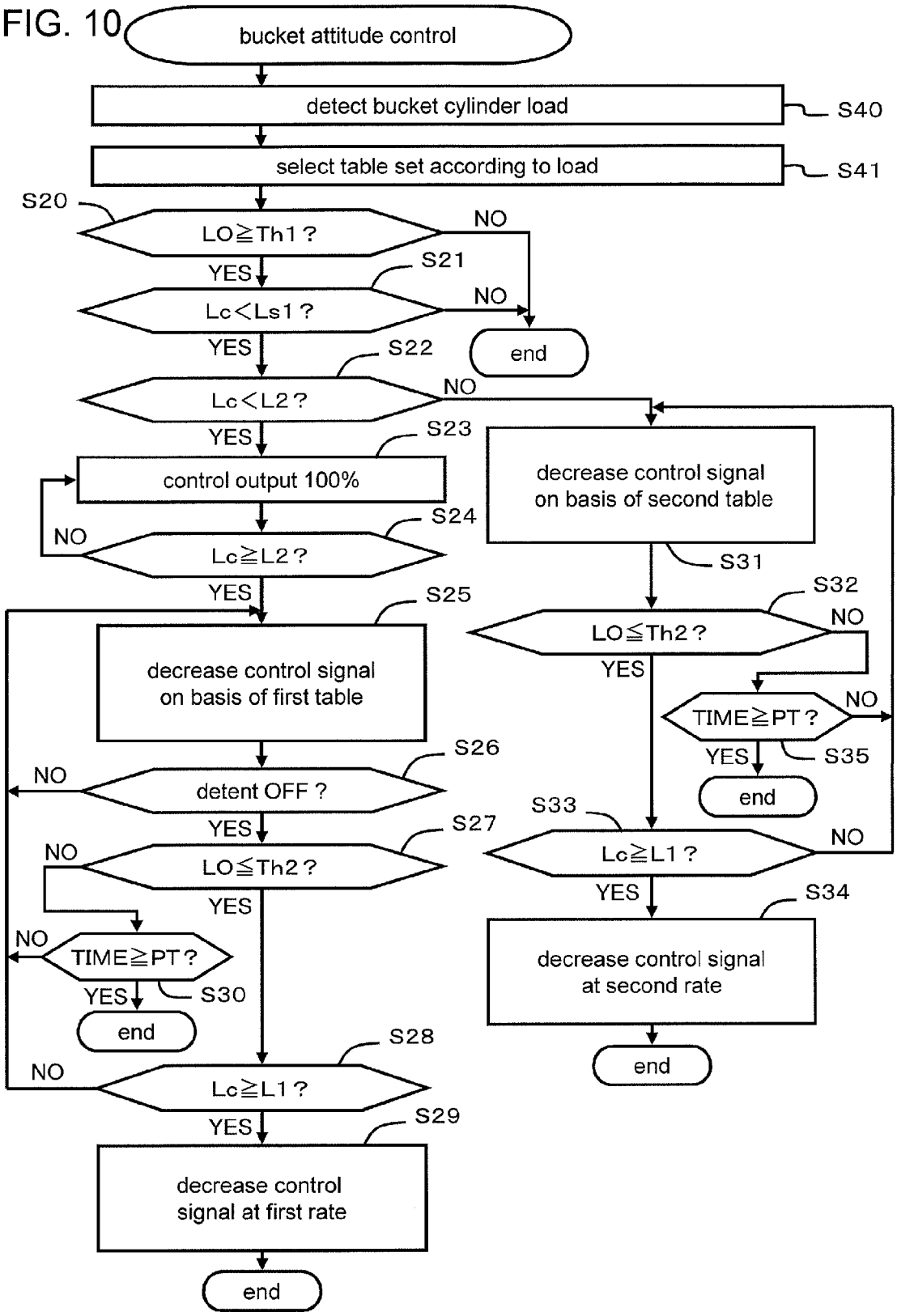
FIG. 10 is a flow chart for a bucket attitude control procedure.

FIG. 10 is a flow chart for the bucket attitude control procedure according to this embodiment. The controller 100A determines the load upon the bucket cylinder 31 (a step S40), and selects a table set (i.e. a set of a first control characteristic and a second control characteristic) according to the load that has been determined (a step S41).

Subsequently, feedback control is performed in a similar manner to that described with reference to FIG. 7 according to the table set that has been selected in correspondence to the load, until the bucket cylinder length reaches the set value L1. After the bucket cylinder length has arrived at the set value L1, then the bucket cylinder length is extended to the target value LS1 according to a predetermined rate (the first rate or the second rate).

This embodiment having the structure described above provides similar beneficial effects to those provided by the first embodiment. Moreover, with this embodiment, it is possible to enhance the stopping accuracy over that provided by the first embodiment, since the set of control characteristics that is used for feedback control is changed over according to the load upon the bucket cylinder 31.

Embodiment #3

A third embodiment will now be explained with reference to FIG. 11. In this third embodiment, not only is the control amount for the feedback control adjusted according to the load upon the bucket cylinder 31, but also the "predetermined rate" that is used in the open loop control is corrected according to the load upon the bucket cylinder 31.

In this embodiment, the first rate is corrected on the basis of the bucket cylinder load detected in a step S40 between the steps S28 and S29 in FIG. 10. In a similar manner, the second rate is corrected on the basis of the bucket cylinder load detected in a step S40 between the steps S33 and S34 in FIG. 10. The controller 100A extends the length of the bucket cylinder to the target value LS1 by using the first rate or the second rate that has been corrected (in the step S29 or the step S34).

Figure 11:
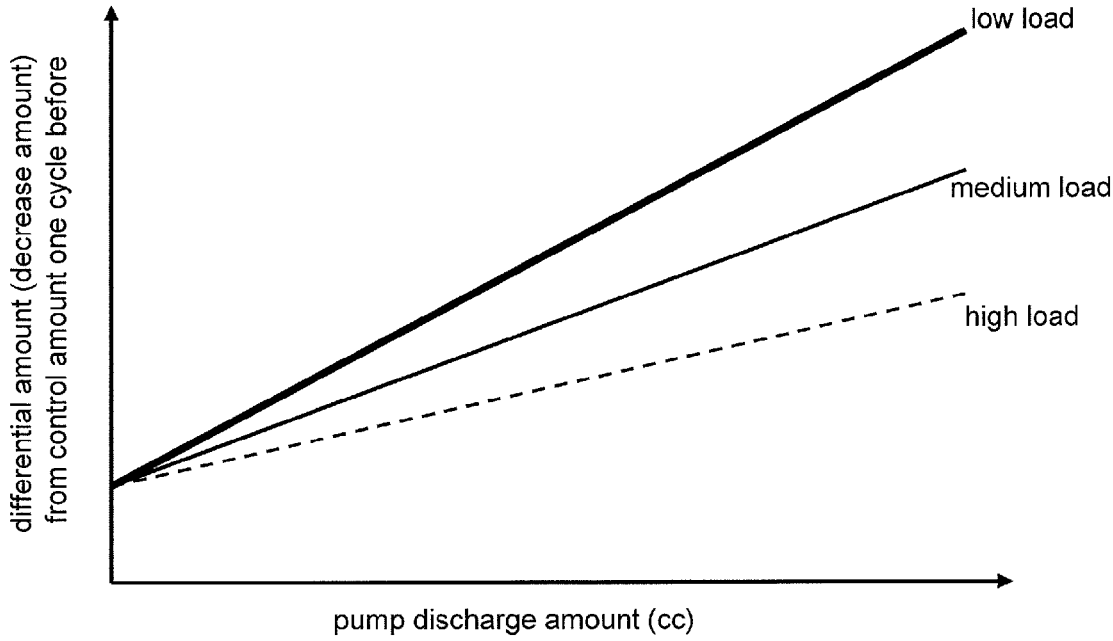
FIG. 11 shows a table for adjustment of a correction amount according to the load on the bucket cylinder.

FIG. 11 shows the characteristic of a table for correcting the control amount during open loop control (i.e. the first rate or the second rate) according to the bucket cylinder load. The amount of difference (i.e. the decrease amount) from the control amount one processing cycle before is shown along the vertical axis, while the discharge amount of the hydraulic pressure pump 201 is shown along the horizontal axis. One processing cycle refers to the cycle that controls the control signal, and this is set to a value of, for example, around 10 msec.

As shown in FIG. 11, the higher the load upon the bucket cylinder 31 is, the smaller the amount subtracted from the control amount one cycle before becomes, and the lower the load upon the bucket cylinder 31 is, the greater the amount subtracted from the control amount one cycle before becomes.

In the case of high load, when the control amount decreases greatly, the amount of decrease from the previous time is made small, since there is a possibility that the cylinder may stop before the stipulated position. By contrast, in the case of low load, the amount of decrease from the previous time is made large, since there is a possibility that the cylinder may overshoot the stipulated position if the decrease amount of the control amount is made small,.

This embodiment having the structure described above also provides similar beneficial effects to those provided by the first embodiment and the second embodiment. Moreover since, with this embodiment, the control amount during the open loop control is corrected according to the bucket cylinder load, accordingly it is possible to enhance the stopping accuracy by yet a further level.

Embodiment #4

Figure 12:
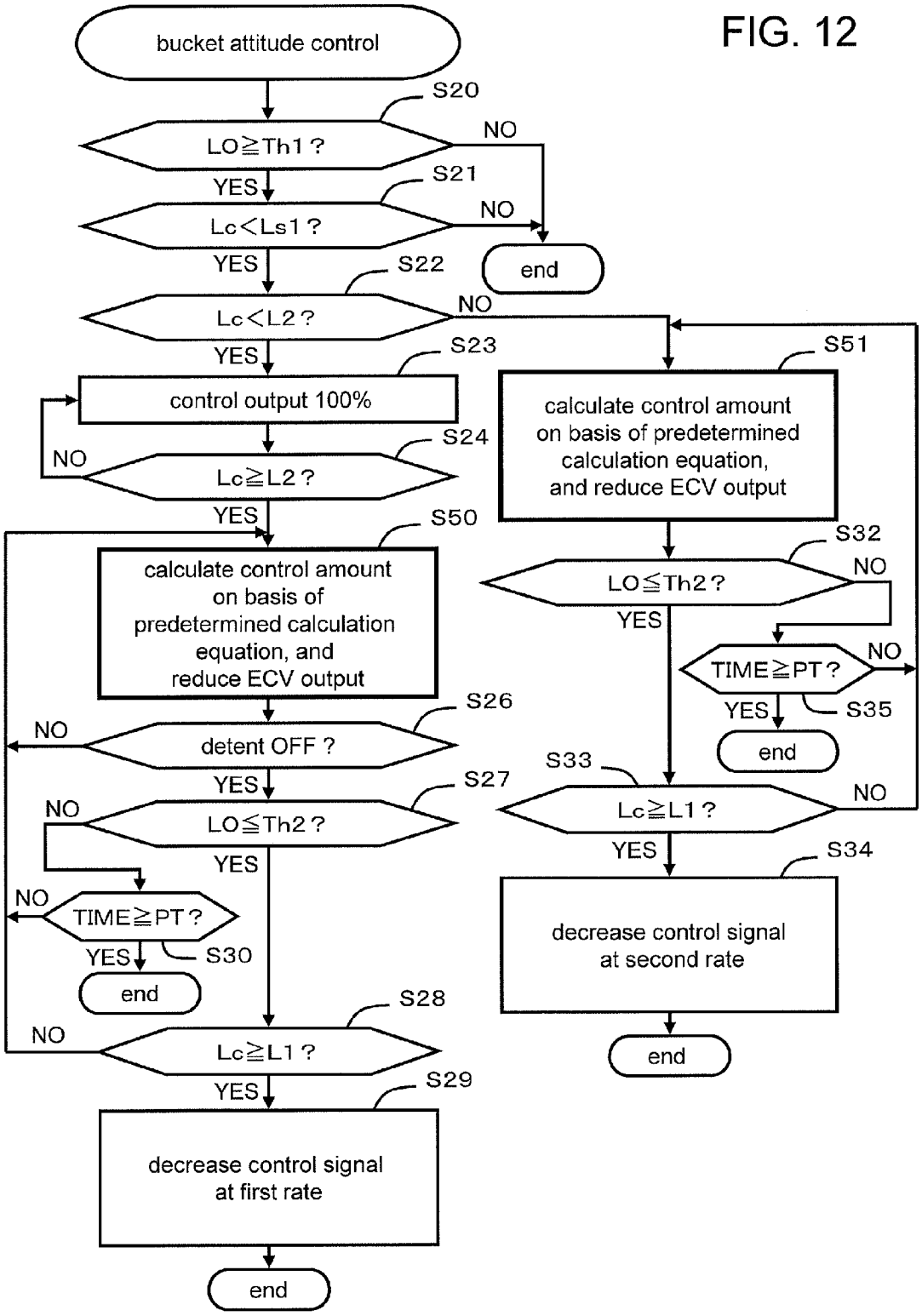
FIG. 12 is a flow chart showing a bucket attitude control procedure according to a fourth embodiment.

A fourth embodiment will now be explained with reference to FIG. 12. In this embodiment, instead of the set of tables corresponding to the load state (104HA, 104HB, 104MA, 104MB, 104LA, 104LB), the predetermined calculation equation shown as Equation 1 below is employed (in steps S50 and S51).

$$y=a(m,m')(xa-x)+b(m,m')\cdot d/dt\cdot(xa-x)+c(m,m')\int(xa-x)\,dt \qquad \text{(Equation 1)}$$

In Equation 1 above, y is the control amount, x is the bucket cylinder length, xa is the stop target, m is the bucket cylinder load, and m' is the time differentiated value of the bucket cylinder load m. Moreover, a(m,m') is the proportional gain, b(m,m') is the derivative gain, and c(m,m') is the integral gain.

In this embodiment, feedback control of the bucket cylinder length is performed on the basis of Equation 1 above (the steps S50 and S51). With Equation 1, the proportional gain, the derivative gain, and the integral gain are adjusted according to the load (m) upon the bucket cylinder 31 and its amount of fluctuation (m'). It should be understood that it is not necessary for proportional control, derivative control, and integral control all to be performed at once; it would also be possible to arrange, for example, for only proportional control and derivative control to be performed (PD control), or for only proportional control and integral control to be performed (PI control). When concrete numerical values are put into Equation 1 described above on the basis of PD control, Formula 1 is obtained:

$$y=\frac{100}{\left(\frac{35000}{m}\right)-\frac{\dot{m}}{10^{-6}}}\frac{(x_{aim}-x)}{100}+\frac{10}{\left(\frac{35000}{m}\right)}\frac{\frac{d}{dt}(x_{aim}-x)}{150} \qquad \text{Formula 1}$$

$X_{aim}$ in Formula 1 corresponds to xa in Equation 1, and mdot in Formula 1 corresponds to m' in Equation 1. In Formula 1, it is supposed that the control amount (control signal) changes in the range from 100% to 0%. Moreover, it will be supposed that the position x when control starts is 100, and that the control signal just before control starts is also 100%.

Furthermore, "35000" is the bucket cylinder load when the boom 20 is horizontal (the standard load). Accordingly, the greater the current bucket cylinder load becomes, the smaller the value of (35000/m) becomes, and the smaller the denominator of the proportional gain becomes, so that the control output increases. The term $(m'/10^{-6})$ is for adjusting the gain according to fluctuation of the bucket cylinder load. This term $(m'/10^{-6})$ is given a negative value, since the bucket cylinder load decreases when the boom 20 lowers. As a result, this acts in the direction to increase of the denominator of the proportional gain, and thus to reduce the control amount.

This embodiment having the structure described above also provides similar beneficial effects to those provided by the first embodiment and the second embodiment. Moreover since, with this embodiment, the control amount for feedback control is calculated on the basis of a calculation equation, accordingly it is not necessary to provide any table sets. Thus, it is possible to economize upon the memory within the controller.

It should be understood that the embodiments of the present invention described above are only given as examples for explanation of the present invention, and that the range of the present invention should not be considered as being limited by those embodiments. Provided that the essence of the present invention is preserved, it could also be implemented in various other ways.

A variant of the second embodiment will now be explained. In this variant embodiment, in the step S29 of FIG. 10, the bucket cylinder length is open loop controlled according to another predetermined calculation equation, shown below as Equation 2. In a similar manner, in the step S34 of FIG. 10 as well, the bucket cylinder length is open loop controlled according to this other predetermined calculation equation shown as Equation 2.

$$y=d(m,m',Q,x0,y0) \quad \text{(Equation 2)}$$

In Equation 2 above, Q is the amount of hydraulic fluid flowing into the bucket cylinder 31 (or the estimated flow rate of hydraulic fluid supplied to the bucket cylinder 31), x0 is the cylinder length of the bucket cylinder 31 when the open loop control starts (in other words, L1 of FIG. 5), and y0 is the control amount when the open loop control starts (in other words, V1 or V2 in FIG. 5).

Equation 2 may be given in more concrete form as Equation 3. For example, if the control amount y0 when the open loop control starts is 45%, and moreover the flow rate of hydraulic fluid supplied to the bucket cylinder 31 is 5000 cc/sec, then the control amount may be decreased by 2.4% in each processing cycle.

$$y=(\text{control amount one processing cycle before})-2.4+10^{-5}(Q-Q0)+10^{-6}(m-m0) \quad \text{(Equation 3)}$$

Since, in this variant embodiment, the control amount for feedback control and the control amount for open loop control are both calculated on the basis of calculation equations, accordingly it is possible to enhance the stopping accuracy by yet a further level.

A first variant of the fourth embodiment will now be explained. In this variant embodiment, in the step S29 of FIG. 12, the bucket cylinder length is open loop controlled according to the other predetermined calculation equation shown as Equation 2 above. In a similar manner, in the step S34 of FIG. 12, the bucket cylinder length is open loop controlled according to the other predetermined calculation equation given by Equation 2.

A second variant of the fourth embodiment will now be explained. In this variant embodiment, both between the steps S28 and S29 and between the steps S33 and S34 of FIG. 12, the predetermined decrease rate (i.e. the first rate) is adjusted according to the load. In other words, the rate at which the control amount is reduced is determined according to the table shown in FIG. 11.

The invention claimed is:

1. A control device for a working mechanism of a construction vehicle for controlling the cylinder length of a predetermined hydraulic cylinder that is used in the working mechanism of the construction vehicle, comprising:

a cylinder length detection unit configured to determine the cylinder length of said predetermined hydraulic cylinder; and a cylinder length control unit configured to control the cylinder length of said predetermined hydraulic cylinder;

wherein said cylinder length control unit is configured to:

(A) in a first region, perform feedback control of the cylinder length by supplying hydraulic fluid to said predetermined hydraulic cylinder on the basis of a control characteristic that is set in advance and the cylinder length determined by said cylinder length detection unit, said first region extending from input of a start command that initiates control of said cylinder length until said cylinder length arrives at a set value that is set before a target value, wherein said control characteristic includes a first control characteristic that is used if the cylinder length at the start of control is less than or equal to a control threshold value and a second control characteristic that is used if the cylinder length at the start of control is greater than said control threshold value; and (B) in a second region, perform open loop control of the cylinder length by supplying hydraulic fluid to said predetermined hydraulic cylinder while decreasing the control signal at a predetermined rate, said second region ranging from said set value until said cylinder length arrives at said target value, wherein said predetermined rate includes a first rate that corresponds to said first control characteristic and a second rate that corresponds to said second control characteristic; and said first rate is used is used if said first control characteristic was used in said first region, and said second rate is used, if said second control characteristic was used in said first region.

2. A control device for a working mechanism of a construction vehicle according to claim 1, wherein:

said cylinder length control unit is configured to:

perform said feedback control on the basis of said first control characteristic if the cylinder length when said start command is inputted is less than or equal to said control threshold value, and perform said feedback control on the basis of said second control characteristic if the cylinder length when said start command is inputted is greater than said control threshold value.

3. A control device for a working mechanism of a construction vehicle according to claim 1, further comprising a load detection unit configured to detect the load imposed upon said predetermined hydraulic cylinder; and wherein said cylinder length control unit is configured to perform said feedback control according to the load detected by said load detection unit.

4. A control device for a working mechanism of a construction vehicle according to claim 3, wherein said cylinder length control unit is configured to perform said open loop control according to the load detected by said load detection unit.

5. A control device for a working mechanism of a construction vehicle according to claim 4, further comprising a correction table configured to correct said first rate and said second rate according to the load; and wherein said cylinder length control unit is configured to perform said open loop control by correcting said first rate or said second rate using said correction table.

6. A control device for a working mechanism of a construction vehicle according to claim 3, wherein:

a plurality of each of said first control characteristic and said second control characteristic are prepared corresponding to said load; and said cylinder length control unit is configured to select a predetermined first control characteristic from among said plurality of first control characteristics according to the load and to select a predetermined second control characteristic from among said plurality of second control characteristics according to the load such that said feedback control is performed on the basis of said predetermined first control characteristic or on the basis of said predetermined second characteristic.

7. A control device for a working mechanism of a construction vehicle according to claim 3, wherein said cylinder length control unit is configured to perform said feedback control by adjusting at least one or a plurality of values among proportional gain, integral gain, and derivative gain that are included in a first calculation equation for obtaining a control amount for said feedback control, on the basis of the value of said load and the value of the derivative of said load.

8. A control device for a working mechanism of a construction vehicle for controlling the cylinder length of a predetermined hydraulic cylinder that is used in the working mechanism of the construction vehicle, comprising:

a cylinder length detection unit configured to determine the cylinder length of said predetermined hydraulic cylinder; and a cylinder length control unit configured to control the cylinder length of said predetermined hydraulic cylinder;

wherein said cylinder length control unit is configured to:

(A) in a first region, perform feedback control of the cylinder length by supplying hydraulic fluid to said predetermined hydraulic cylinder on the basis of a control characteristic that is set in advance and the cylinder length determined by said cylinder length detection unit, said first region extending from input of a start command that initiates control of said cylinder length until said cylinder length arrives at a set value that is set before a target value, wherein said control characteristic includes a first control characteristic that is used during feedback control, if the cylinder length at the start of control is less than or equal to a control threshold value; and a second control characteristic that is used during feedback control, if the cylinder length at the start of control is greater than said control threshold value; said first control characteristic is set so as to decrease continuously according to a predetermined first characteristic line from the maximum value of a control signal to a control valve for supplying hydraulic fluid to said predetermined hydraulic cylinder to a first predetermined value; and said second control characteristic is set so that a control signal that is larger than said first characteristic line is obtained in an earlier almost half portion of said first region, and moreover so that a control signal that is smaller than said first characteristic line is obtained in the latter half portion of said first region;

(B) in a second region, perform open loop control of the cylinder length by supplying hydraulic fluid to said predetermined hydraulic cylinder while decreasing the control signal at a predetermined rate, said second region ranging from said set value until said cylinder length arrives at said target value.

9. A control method for controlling the cylinder length of a predetermined hydraulic cylinder that is used in the working mechanism of a construction vehicle, comprising:

detecting the cylinder length of said predetermined hydraulic cylinder; and controlling the cylinder length by:

feedback controlling the cylinder length in a first region by supplying hydraulic fluid to said predetermined hydraulic cylinder on the basis of a control characteristic that is set in advance and the detected cylinder length, said first region extending from input of a start command that initiates control of said cylinder length until said cylinder length arrives at a set value that is set before a target value, wherein said control characteristics includes a first control characteristic that is used during said feedback controlling, if the cylinder length at the start of control is less than or equal to a control threshold value; and a second control characteristic that is used during said feedback controlling, if the cylinder length at the start of control is greater than said control threshold value;

open loop controlling the cylinder length in a second region by supplying hydraulic fluid to said predetermined hydraulic cylinder while decreasing the control signal at a predetermined rate from said set value until said cylinder length arrives at said target value, wherein said predetermined rate includes a first rate that corresponds to said first control characteristic and a second rate that corresponds to said second control characteristic; and said first rate is used if said first control characteristic was used in said first region, and said second rate is used, if said second control characteristic was used in said first region.

10. A control method for a working mechanism of a construction vehicle according to claim 9, further comprising:

detecting the load imposed upon said predetermined hydraulic cylinder; and performing said feedback control according to the load that is detected.

* * * * *